US009451666B1

(12) United States Patent
Cho et al.

(10) Patent No.: US 9,451,666 B1
(45) Date of Patent: Sep. 20, 2016

(54) ADJUSTABLE LIGHTING DRIVER

(71) Applicants: Nam Chin Cho, Peachtree City, GA (US); Vaske Mikani, Senoia, GA (US)

(72) Inventors: Nam Chin Cho, Peachtree City, GA (US); Vaske Mikani, Senoia, GA (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 14/794,579

(22) Filed: Jul. 8, 2015

(51) Int. Cl.
*H05B 37/02* (2006.01)
*H05B 33/08* (2006.01)

(52) U.S. Cl.
CPC ..... *H05B 33/0845* (2013.01); *H05B 37/0209* (2013.01)

(58) Field of Classification Search
CPC ..... H05B 33/0845; H05B 37/0209
USPC ..... 315/291, 307, 224
See application file for complete search history.

(56) References Cited

U.S. PATENT DOCUMENTS 8,610,365 B2 12/2013 King
2010/0164406 A1 7/2010 Kost
2011/0309759 A1* 12/2011 Shteynberg ..... H05B 33/0815 315/201
2013/0069561 A1 3/2013 Melanson

OTHER PUBLICATIONS

LEDs Magazine; Improve phase-cut dimming performance in LED luminaires; Dec. 2013.

* cited by examiner

*Primary Examiner* — Daniel D Chang
(74) *Attorney, Agent, or Firm* — King & Spalding LLP

(57) ABSTRACT

A method of adjusting output power of a lighting driver includes setting output power of the driver to a maximum output power of the driver, the maximum output power of the driver corresponding to a brightest setting of a dimmer. The output power of the driver is adjustable by adjusting a dim level setting of the dimmer. The method further includes adjusting the dim level setting of the dimmer to a new setting that is different from the brightest setting of the dimmer. The new setting of the dimmer corresponds to an amount of the output power of the driver that is less than the maximum output power of the driver. The method also includes associating, by the driver, the brightest setting of the dimmer with the amount of the output power of the driver that is less than the maximum output power of the driver.

20 Claims, 6 Drawing Sheets

ADJUSTABLE LIGHTING DRIVER

TECHNICAL FIELD

The present disclosure relates generally to lighting solutions, and more particularly to adjusting output of a driver.

BACKGROUND

A driver (e.g., an LED driver) is often used to provide power to the light sources of a lighting device. In some applications, a dimmer may be used to control the power that is provided by the driver to a light source to control the intensity of light emitted by a light source. For example, a phase-cut dimmer or a 0-10 volt dimmer may be used to control the dim level of light emitted by a light emitting diode ("LED") light source.

As more progress is made in LED technology, the efficiency of LEDs continues to improve. To illustrate, improvements in LED technology may result in higher luminosity of the light emitted by an LED for the amount of power. For example, for the same dimmer setting, an LED that is based on an improved LED technology may emit a light having a higher luminosity than a light emitted by an LED that is based on an older LED technology. To illustrate, when an existing LED light source is replaced by a new LED light source, the brightest dimmer setting of a dimmer may result in the light emitted by the replacement LED being undesirably too bright. Thus, in some circumstances, it may be undesirable to set a dimmer to the brightest setting. For example, instead of setting the dimmer to the brightest setting, a consumer may be forced to regularly find an optimum dimmer setting of the dimmer that is different from the brightest setting of the dimmer in order to achieve a desired brightness level of the light emitted by the replacement LED light source. Further, because a desired brightness of light may be achieved by providing less power to the LED as compared to the power that is provided to the replaced LED light source to achieve the same brightness level, the power consumption of the replacement LED may be reduced without sacrificing a desired maximum brightness level of light emitted by the replacement LED light source.

Thus, a solution that allows the driver to adapt to a desired maximum brightness level of light emitted by a light source powered by the driver is desirable.

SUMMARY

The present disclosure relates generally to lighting solutions. In an example embodiment, a method of adjusting output power of a lighting driver that corresponds to a brightest setting of a dimmer includes setting output power of the driver to a maximum output power of the driver, the maximum output power of the driver corresponding to a brightest setting of a dimmer. The output power of the driver is adjustable by adjusting a dim level setting of the dimmer. The method further includes adjusting the dim level setting of the dimmer to a new setting that is different from the brightest setting of the dimmer. The new setting of the dimmer corresponds to an amount of the output power of the driver that is less than the maximum output power of the driver. The method also includes associating, by the driver, the brightest setting of the dimmer with the amount of the output power of the driver that is less than the maximum output power of the driver.

In another example embodiment, a lighting system includes a dimmer, a light source, and an adjustable lighting driver coupled to the dimmer and to the light source. The adjustable lighting driver includes a memory device to store values corresponding to different amounts of output power of the driver. The values are stored in the memory device in association with values corresponding to different dim level settings of the dimmer. The adjustable lighting driver provides the output power to the light source. The adjustable lighting driver further includes a logic module to generate the values that are stored in the memory device. A first value of the values stored in the memory device is generated based on a new dim level setting of the dimmer that is different from a brightest setting of the dimmer. The new dim level setting of the dimmer corresponds to an amount of the output power of the driver that is less than a maximum output power of the driver. The first value of the values is stored in the memory device in association with a value corresponding to the brightest setting of the dimmer. The adjustable lighting driver also includes a power processor to provide the output power to the light source based on the values stored in the memory device. The power processor provides to the light source the amount of the output power of the driver that is less than the maximum output power of the driver based on the first value when the dimmer is set to the brightest setting of the dimmer.

In another example embodiment, a lighting fixture includes a light emitting diode (LED) light source comprising one or more LEDs and an adjustable lighting driver coupled to the light source. The adjustable lighting driver includes a memory device to store values corresponding to different amounts of output power of the driver, wherein the values are stored in the memory device in association with values corresponding to different dim level settings of a dimmer. The adjustable lighting driver provides the output power to the light source. The adjustable lighting driver further includes a logic module to generate the values that are stored in the memory device. A first value of the values stored in the memory device is generated based on a new dim level setting of the dimmer that is different from a brightest setting of the dimmer, wherein the new dim level setting of the dimmer corresponds to an amount of the output power of the driver that is less than a maximum output power of the driver. The first value of the values is stored in the memory device in association with a value corresponding to the brightest setting of the dimmer. The adjustable lighting driver also includes a power processor to provide the output power to the light source based on the values stored in the memory device, wherein the power processor provides to the light source the amount of the output power of the driver that is less than the maximum output power of the driver based on the first value when the dimmer is set to the brightest setting of the dimmer.

These and other aspects, objects, features, and embodiments will be apparent from the following description and the appended claims.

BRIEF DESCRIPTION OF THE FIGURES

Reference will now be made to the accompanying drawings, which are not necessarily drawn to scale, and wherein.

Figure 1:
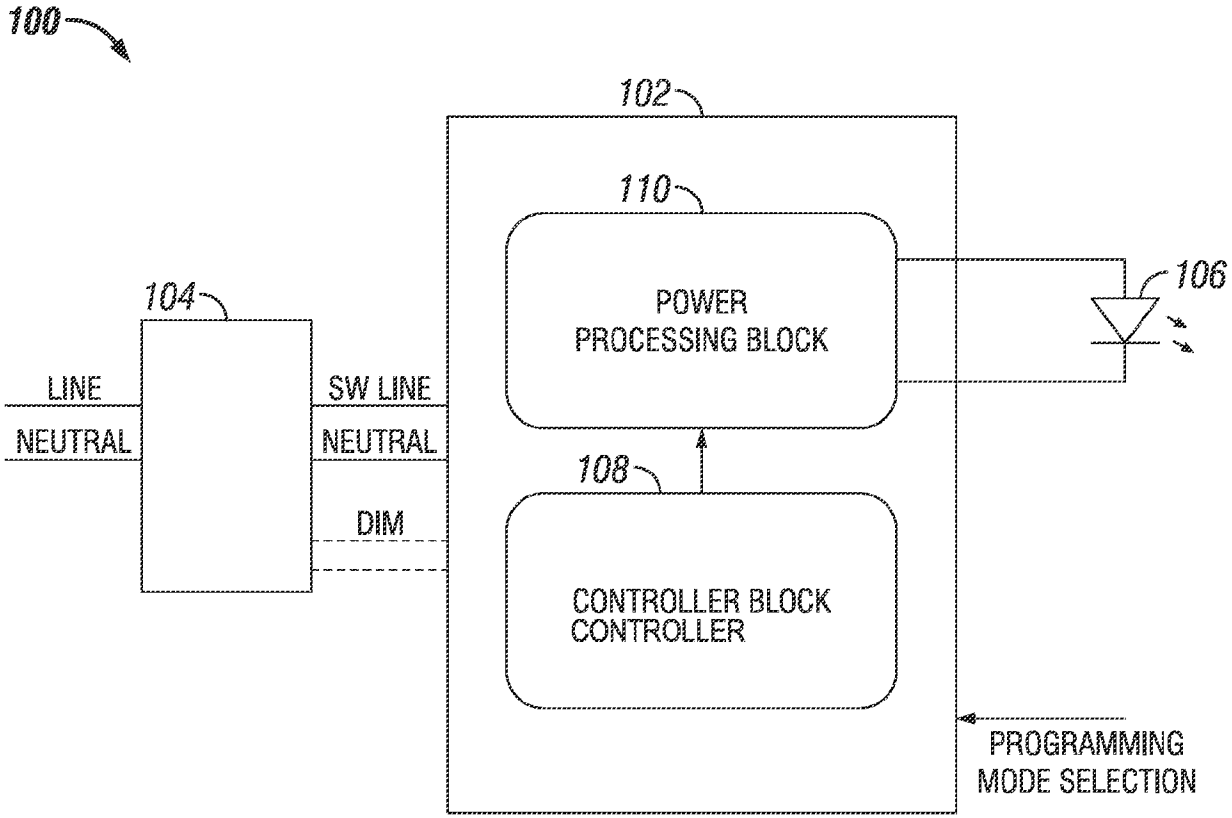
FIG. 1 illustrates a lighting system including an adjustable lighting driver according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, reference numerals designate like or corresponding, but not necessarily identical, elements.

DETAILED DESCRIPTION OF THE EXAMPLE EMBODIMENTS

In the following paragraphs, example embodiments will be described in further detail with reference to the figures. In the description, well known components, methods, and/or processing techniques are omitted or briefly described. Furthermore, reference to various feature(s) of the embodiments is not to suggest that all embodiments must include the referenced feature(s).

Turning now to the figures, particular embodiments are described. FIG. 1 illustrates a lighting system 100 including an adjustable lighting driver 102 according to an example embodiment. As illustrated in FIG. 1, the lighting system 100 includes the adjustable lighting driver 102, a dimmer 104, and a light emitting diode (LED) light source 106. The brightness level of light emitted by the LED light source 106 may be adjusted by adjusting the dim level setting of the dimmer 104. In some example embodiments, the driver 102 may be programmed to change the brightness level of the light emitted by the LED light source 106 for a particular dim level setting of the dimmer 104.

In some example embodiments, the LED light source 106 may include one or more LEDs. The one or more LEDs may be one or more discrete LEDs, one or more organic light-emitting diodes (OLEDs), an LED chip on board that includes one or more discrete LEDs, an array of discrete LEDs, or light source(s) other than LEDs. In some alternative embodiments, light source other than an LED light source may be used in the system 100.

In some example embodiments, the dimmer 104 may be a phase-cut (triac) dimmer that generates an output electrical signal on a connection (SW line) by limiting the power that is transferred from a power source (e.g., mains power source) to the driver 102. For example, power from a power source may be provided to the dimmer 104 via connections (Line), (Neutral). When the dimmer 104 is a phase-cut dimmer, dim level information that conveys the dim level setting of the dimmer 104 is provided to the driver 102 via the electrical signal on the connection (SW line). When the dimmer 104 is a phase-cut dimmer, one or more connections (Dim) are unused. In some example embodiments, the power source that provides power to the system 100 may be a 120-volt, 60-Hertz power source. Alternatively, the power source may be 210-volt, 50-Hertz or another power source.

In some example embodiments, the dimmer 104 may be a 0-10 volt dimmer or another type of dimmer. For example, when the dimmer 104 is a 0-10 volt dimmer, connections (SW line), (Neutral) may be used to provide a switched power to the driver 102, and the one or more connections (Dim) may carry dim level information that conveys the dim level setting of the dimmer 104 to the driver 102. To illustrate, the connections (Dim) may carry one or more electrical signals having voltage ranging from 0 volt to 10 volts depending on the dim level setting of the dimmer 104.

In some example embodiments, the dimmer 104 may have a slider for adjusting the dim level setting of the dimmer 104. Alternatively, the dim level setting may be controlled by other means, such as a rotatable knob, known to those of ordinary skill in the art.

In some example embodiments, the driver 102 may receive dim level information from the dimmer 104 and provide power to the LED light source 106 based on the dim level information. For example, the driver 102 may provide a maximum output power to the LED light source 106 when the dimmer 104 is set to the brightest setting of the dimmer 104. Similarly, the driver 102 may provide a minimum output power to the LED light source 106 when the dimmer 104 is set to the dimmest setting of the dimmer 104.

When the dimmer 104 is a phase-cut dimmer, the power provided to the light source 106 by the driver 102 is in proportion to the conduction duration of the electrical signal provided by the dimmer 104 to the driver 102 via the connection (SW line). Because the conduction duration of the electrical signal provided by the dimmer 104 on the connection (SW line) is related to the dim level setting of the dimmer 104, changing the dim level setting of the dimmer 104 results in a change in the power provided to the LED light source 106.

When the dimmer 104 is a 0-10 volt dimmer, the power provided to the light source 106 by the driver 102 is in proportion to the voltage level of the electrical signal on the one or more connections (Dim). Because the voltage level of the electrical signal provided by the dimmer 104 on the one or more connections (Dim) is proportional to the dim level setting of the dimmer 104, changing the dim level setting of the dimmer 104 changes the voltage level of the electrical signal, resulting in a change in the power provided to the LED light source 106.

In some example embodiments, the driver 102 may include a controller block 108 and a power processing block 110. For example, the power processing block 110 provides power to the LED light source 106 based on one or more control signals from the controller block 108. To illustrate, in some example embodiments, the controller block 108 may provide a pulse-width value to the power processing block 110, and the power processing block 110 may output to the LED light source 106 an electrical signal having a pulse width corresponding to the pulse-width value. As those of ordinary skill in the art can readily understand, the amount of power provided to the LED light source 106 may depend on the pulse width of the electrical signal, and the brightness level of light emitted by the LED light source 106 may depend on the amount of power provided to the LED light source 106.

In some example embodiments, the brightness level of light emitted by the LED light source 106 that corresponds to the brightest setting of the dimmer 104 may be changed by programming the driver 102. For example, the driver 100 may initially be configured such that the brightest setting of the dimmer 104 results in the LED light source 106 emitting a light having the brightest level that the LED light source 106 can emit based on the power provided by the driver 102. To illustrate, the driver 102 may be initially configured such that the brightest setting of the dimmer 104 results in the driver 102 providing to the LED light source 106 a maximum output power that the driver 104 can provide, for example, based on a default (e.g., factory) configuration of the driver 102.

To change the brightness level of the light that is emitted based on a particular dim level setting of the dimmer 104, the driver 102 may be programmed to change the amount of power that the driver 102 provides to the LED light source 106 for the particular dim level setting of the dimmer 104. For example, the driver 102 may be programmed such that, when the dimmer 104 is set to the brightest setting of the dimmer 104, the driver 102 provides to the LED light source 106 output power that is less than the maximum output power. For example, the maximum output power may correspond to the amount of output power that the driver 102 provides to the LED light source 106 based on a default/factory configuration of the driver 102.

Such programming of the driver 102 to change the amount of the output power of the driver 102 that corresponds to the brightest setting of the dimmer 104 to less than the maximum amount of output power of the driver 102 may result in the light emitted by the LED light source 106 being dimmer than the brightest level of the light prior to such programming. The amount of power that the dimmer 104 provides to the LED light source 106 for dim level settings of the dimmer 104 other than the brightest setting of the dimmer 104 may also be changed by programming the driver 102 based on a desired dimming curve (e.g., a linear curve, an S curve, a square law curve, etc.) and the amount of output power of the driver 102 that is less than the maximum output power of the driver 102 and that corresponds to the brightest setting of the dimmer 104 after the programming.

In some example embodiments, the driver 102 may first be set (e.g., programmed or reset) to provide the maximum (e.g., default) output power to the LED light source 106 prior to programming the driver 102 to change the output power that correspond to the brightest setting of the dimmer 104 to less than the maximum (e.g., default) output power of the driver 102. For example, the driver 102 may have been previously programmed to change the amount of output power provided to the LED light source 106 to less than the maximum (e.g., default) output power of the driver 102 when the dimmer 104 is set to the brightest setting. Further, in some cases, it may be unknown whether the driver 102 has been previously programmed to change the amount of output power provided to the LED light source 106 to less than the maximum (e.g., default) output power of the driver 102 when the dimmer 104 is set to the brightest setting.

In some example embodiments, the driver 102 may be programmed during a programming mode selected via the Programming Mode Selection input of the driver 102 or via other means as may be contemplated by those of ordinary skill in the art with the benefit of this disclosure. For example, after entering the programming mode, the driver 102 may be programmed or reset such that the driver 102 provides the maximum (e.g., default) output power to the LED light source 106 when the dimmer 104 is set to the brightest setting. To illustrate, the controller block 108 may be programmed/reset such that, when the dimmer 104 is set to the brightest setting, the power processing block 110 provides the maximum output power to the LED light source 106 based on a control signal from the controller block 108.

During the programming mode of the driver 102, after the driver 102 is set (e.g., programmed or reset) to provide the maximum (e.g., default) output power to the LED light source 106 when the dimmer 104 is set to the brightest setting, the dim level setting of the dimmer 104 may be adjusted until the LED light source 106 emits the light with a desired brightness level that is less bright than the brightest level that corresponds to maximum output power of the driver 102. As a non-limiting example, a dimmer setting that is ninety percent or eighty percent of the brightest setting of the dimmer 104 may result in a desired brightness level of the light emitted by the LED light source 106.

In some example embodiments, the dimmer setting that results in the desired brightness level of the light may be determined/selected by visually checking the light emitted by the LED light source 106 as the dimmer setting of the dimmer is changed. Alternatively, a dimmer setting that results in the desired brightness level of the light may be selected/determined by other means without visually looking at the light emitted by the LED light source 106.

After the dim level setting of the dimmer 104 that results in the desired brightness level of the light is determined, the driver 102 may be programmed such that, when the dimmer 104 is set to the brightest level, the driver 102 provides to the LED light source 106 the amount of output power that resulted in the desired brightness level. Thus, after the programming of the driver 102, when the dimmer 104 is set to the brightest setting, the driver 102 provides to the LED light source 106 an amount of output power that is less than the maximum (e.g., default) output power that resulted in the brightest level of the light.

In some example embodiments, the driver 102 may also be programmed to change the amount of the output power that the driver 102 provides to the LED light source 106 for dim level setting of the dimmer 104 other than the brightest setting. For example, the amount of output power that the driver 102 provides to the LED light source 106 for dim level setting other than the brightest setting may be determined based on a desired dimming curve (e.g., a linear curve, an S curve, a square law curve, etc.). The driver 102 may be programmed such that the amount of output power that the driver 102 provides to the LED light source 106 for dim level setting of the dimmer 104 other than the brightest setting is less than the amount of power that the driver 102 provides to the LED light source 106 for the brightest setting of the dimmer 104.

In some example embodiments, the driver 102 and the LED light source 106 may be included in a light fixture. Alternatively, the system 100 may itself be a light fixture. In some alternative embodiments, the dimmer 104 and the driver 102 may have more or fewer electrical connections than shown in FIG. 1. Although the system 100 is described as including the LED light source 106, in some alternative embodiments, the system may include other types of light sources.

In some example embodiments, the conduction duration counter block 112 may determine the minimum and maximum conduction durations and store the corresponding values as well as the intermediate values in the memory block 114 during a training mode operation of the adaptive driver 102. To illustrate, in some example embodiments, Mode Selection Input or other means may be used to select a training mode operation of the adaptive driver 102. For example, using the Mode Selection Input (e.g., a switch, a keyboard input, etc.), a user may select a training mode during which the adaptive driver 102 stores values, corresponding to conduction durations and generated as described above, in the memory block 114.

In some example embodiments, the adaptive driver 102 and the LEDs 106 may be included in a light fixture. Alternatively, the system 100 may be a light fixture.

Figure 2A:
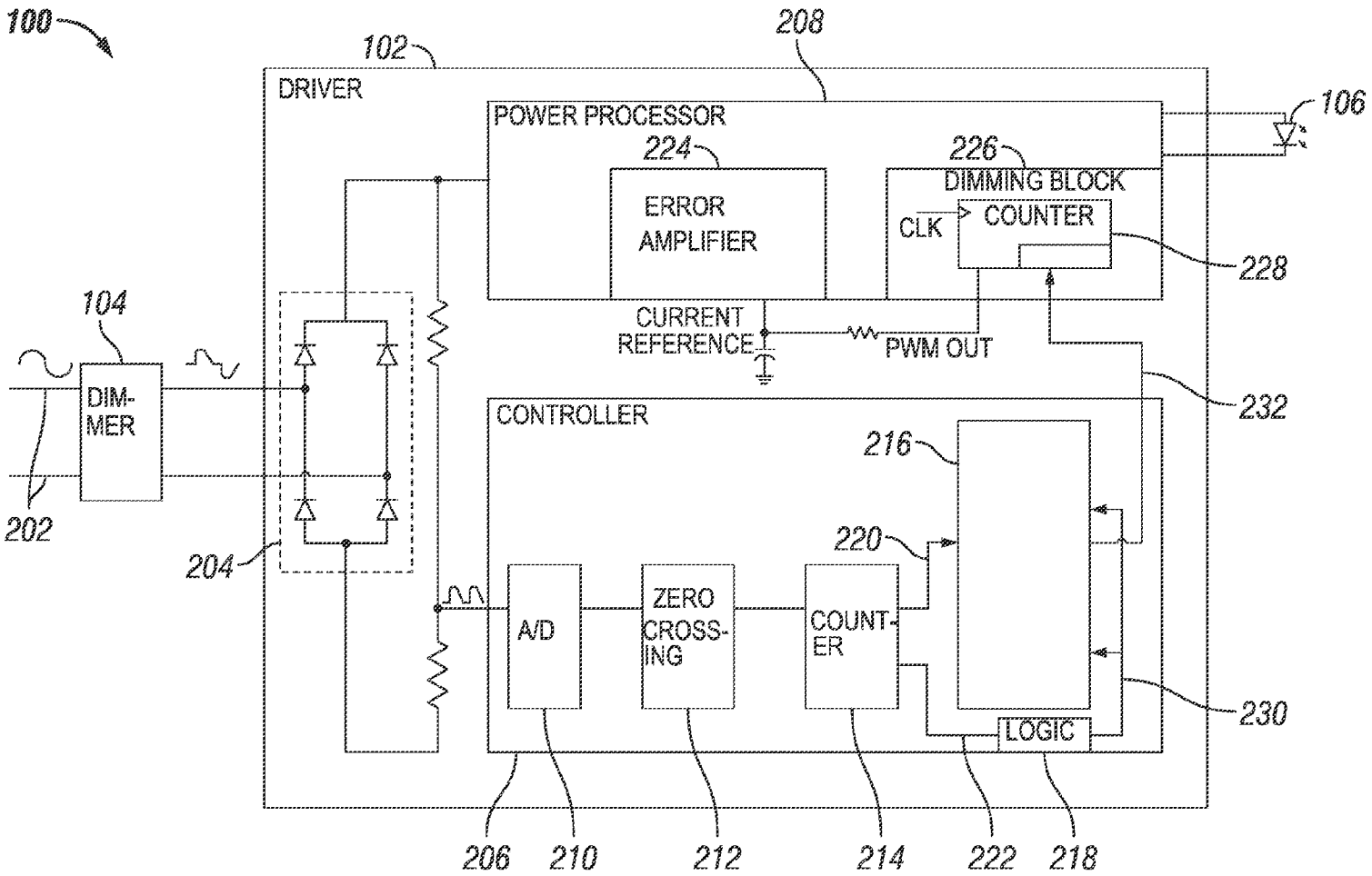
FIGS. 2A and 2B illustrate details of the system of FIG. 1 according to an example embodiment.
Figure 2B:
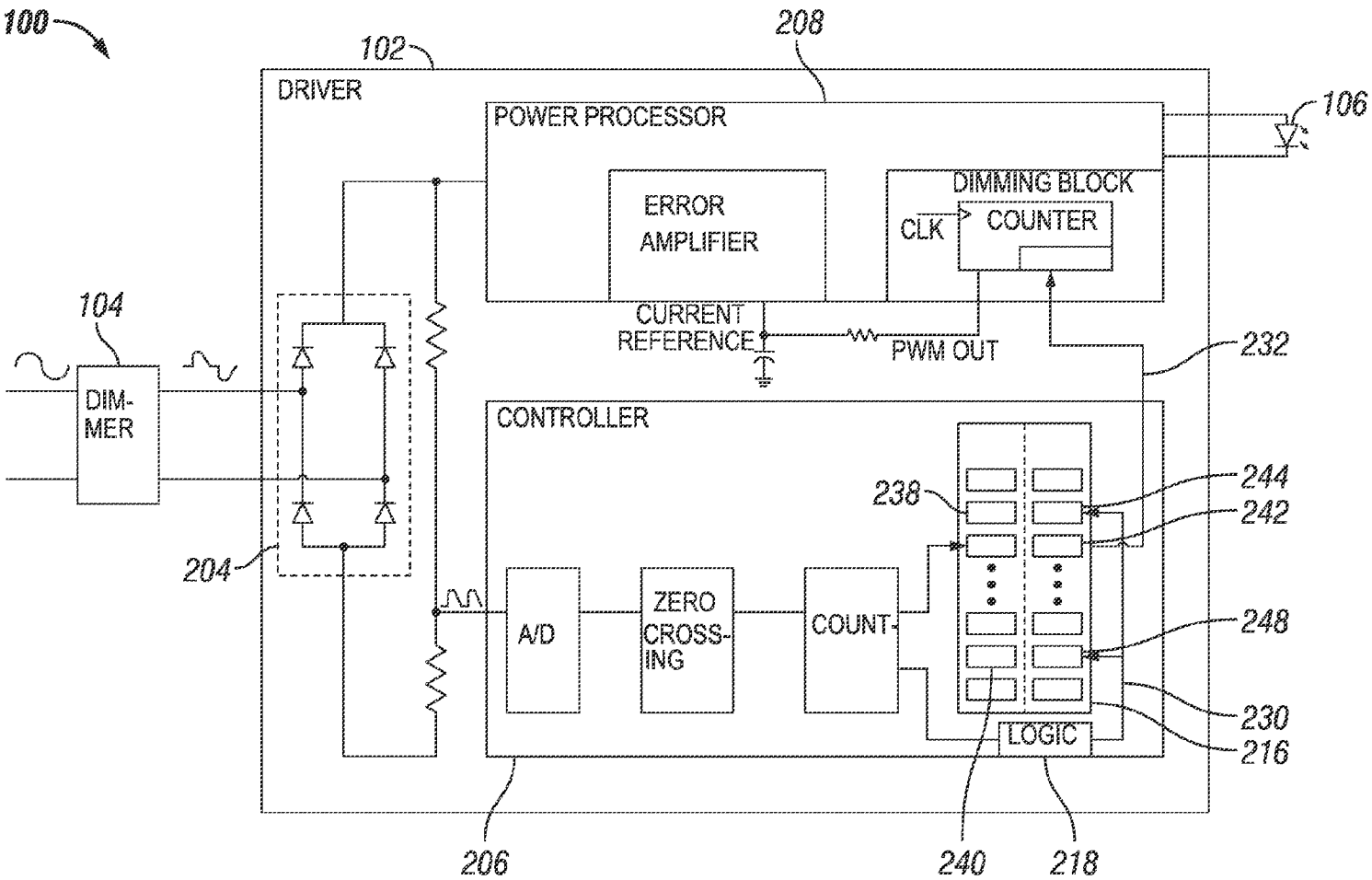

FIGS. 2A and 2B illustrate details of the lighting system 100 of FIG. 1 according to an example embodiment. Referring to FIGS. 2A and 2B, the system 100 includes the adjustable lighting driver 102, the dimmer 104, and the LED light source 106. Power from a power source (e.g., mains power source) may be provided to the dimmer 104 via connections 202. The dimmer 104 may be a triac dimmer that provides an electrical signal to the driver 102 based on the dim level setting of the dimmer 104.

In general, the conduction duration of the electrical signal provided to the driver 102 by the dimmer 104 corresponds to the dim level setting of the dimmer 104. For example, the electrical signal generated by the dimmer 104 may have a maximum conduction duration when the dimmer 104 is set to the brightest setting. The electrical signal may have the minimum conduction duration when the dimmer 104 is set to the dimmest setting. The electrical signal has intermediate conduction durations that are between the maximum and minimum conduction durations when the dimmer 104 is set to a dim level setting that is between the brightest and dimmest settings.

In some example embodiments, conduction durations may be expressed in terms of time units or degrees. To illustrate, for a 60-Hz power source, a maximum conduction duration must be less than approximately 8.3 milliseconds (ms) or 180 degrees. For example, the maximum conduction duration may be approximately 6.9 ms or 150 degrees, and a minimum conduction duration may be approximately 1.4 ms or 30 degrees. For a 50-Hz power source, a maximum duration must be less than 10 milliseconds (ms) or 180 degrees. For example, for a 50-Hz power source, the maximum conduction duration may be approximately 8.3 ms or 150 degrees, and a minimum conduction duration may be approximately 1.7 ms or 30 degrees.

In some example embodiments, the driver 102 includes a rectifier 204, a controller 206, and a power processor 208. The rectifier 204 may receive and rectify the electrical signal provided by the dimmer 104. Although a particular rectifier is shown in FIGS. 2A and 2B, in alternative embodiments, a different rectifier may be used to rectify the electrical signal. As shown in FIGS. 2A and 2B, the rectified signal is provided to the Controller 206. For example, the controller 206 may include an analog-to-digital converter (A/D) 210, a zero crossing block 212, a conduction duration counter 214, a memory device 216, and a logic block 218. In some example embodiments, the zero crossing block 212, the conduction duration counter 214, and/or the logic block 218 may be implemented in hardware, software, or a combination thereof.

The A/D converter 206 may convert the rectified analog electrical signal into a digital electrical signal and provide the digital electrical signal to the zero crossing block 212. The zero crossing block 212 may determine zero crossings of the electrical signal provided by dimmer 104 based on the digital electrical signal and generate an output signal that indicates zero crossings. The signal generated by the zero crossing block 212 is provided to the conduction duration counter 214. The conduction duration counter 214 may determine the conduction duration of the electrical signal generated by dimmer 104 based on the output of the zero crossing block 212.

During normal operations of the system 100, where a user uses the dimmer 104 to change the brightness level of light emitted by the LEDs 106, the output of the conduction duration counter 214 is used by the driver 102 in the reading/outputting values from the memory device 216 that correspond to the conduction durations of the electrical signal generated by the dimmer 104. The values read/output from the memory device 216 are be provided to the power processor 208 via a connection 232 (e.g., one or more electrical wires) and are be used by the power processor 208 in generating the output power that is provided to the LED light source 106. For example, the values stored in the memory device 216 may be pulse-width-modulation values (e.g., duty cycle values, pulse-width, etc.) that are used to control the amount of power provided to the LED light source 106. When the dim level setting of the dimmer 104 changes (which results in a change of the conduction duration), a value corresponding to the changed conduction duration may be read from the memory device 216, resulting in a different amount of power being provided by the power processor 208 to the LED light source 106.

In some example embodiments, the power processor 208 may include an error amplifier 224 and a dimming block 226 that includes a pulse-width-modulation (PWM) generator 228. For example, the PWM generator 228 may receive a value (e.g., a pulse-width value) stored in the memory device 216, and the dimming block 226 in conjunction with the error amplifier 224 may operate to control the amount of output power provided to the LED light source 106.

In some example embodiments, the values stored in the memory device 216 may be default (e.g., set by manufacturer of the driver 102) or previously user programmed values that are stored in association with respective conduction durations of the electrical signal from the dimmer 104. For example, the default or user programmed values may be pulse-width-modulation values. To illustrate, based on a default value stored in the memory device 216, the driver 102 may provide a maximum amount of output power to the LED light source 106 when the electrical signal from the dimmer 104 has the maximum conduction duration. As explained above, the electrical signal generated by the dimmer 104 may have the maximum conduction duration when the dimmer 104 is set to the brightest setting.

In some example embodiments, the driver 102 may be programmed to change the brightness level of the light emitted by the LED light source 106 for a particular dim level setting of the dimmer 104. In particular, the driver 102 may be programmed to change the amount of power that the driver 102 provides to the LED light source 106 for a particular conduction duration of the electrical signal provided to the driver 102 by the dimmer 104. To illustrate, the driver 102 may be programmed such that, when the dimmer 104 is set to the brightest setting of the dimmer 104, the driver 102 provides to the LED light source 106 output power that is less than the maximum output power, which may be the default output power that corresponds to the brightest setting of the dimmer 104. That is, the maximum output power may correspond to the amount of output power that the driver 102 provides to the LED light source 106 based on a default/factory configuration of the driver 102.

In some example embodiments, after the driver 102 enters a programming mode, the driver 102 may be programmed/reset to provide the maximum output power to the LED light source 106 when the dimmer 104 is set to the brightest setting. For example, the memory device 216 may be loaded with default values (e.g., PWM values based on manufacturer's configuration) that correspond to different dim level settings of the dimmer 104. In some example embodiments, the default values may be stored in another memory device.

After the driver 102 is programmed/reset to provide the maximum output power to the LED light source 106, the dimmer 104 may be set to a dim level setting that results in the LED light source 106 emitting a light having a desired brightness level. The logic block 218 may then determine the value (e.g., PWM value) read from the memory device 216 and that resulted in the desired brightness level. The logic block 218 may then store the value in the memory device 216 in association with the maximum conduction duration of the electrical signal provided by the dimmer 104, which is reflective of the brightest setting of the dimmer 104. For example, the logic block 218 may store the value in the memory location 244 in association with the location/address/index 238, which corresponds to the maximum conduction duration of the electrical signal provided to the driver 102 when the dimmer 104 is set to the brightest setting. The logic block 218 may store the value in the memory device 216 via a connection 230, which may include one or more electrical connections.

The logic block 218 may also store, in the memory device 216, other values in association with other conduction durations of the electrical signal generated by the dimmer 104. For example, the location/address/index 240 may correspond to the minimum conduction duration of the electrical signal, and a value corresponding to a minimum output power provided to the LED light source 106 may be stored in memory location 248. The logic block 218 may determine (e.g., calculate, retrieve, etc.) values that correspond to other amounts of the output power of the driver 102 based on the value stored in the memory location 244 and the value stored in the memory location 248. For example, the logic block 218 may generate the values based on a desired dimming curve, such as a linear curve, a square law curve, an S curve, etc. The values may be stored in memory locations such as memory location 242 in association with respective conduction durations of the electrical signal provided to the driver 102 by the dimmer 104.

After the programming of the driver 102 is completed as described above, the driver 102 may be operated in a normal mode to provide power to the LED light source 106 based on the dim level setting of the dimmer 104. Because the driver 102 has been programmed to provide to the LED light source 106 less power than the maximum (e.g., default) output power when the dimmer 104 is set to the brightest setting, the light emitted by the LED light source 106 is dimmer as compared to the brightness level prior to the programming of the driver 102.

In some example embodiments, the controller 206, the rectifier 204, the A/D 210, the zero crossing block 212, the conduction duration counter 214, the memory device 216, and the logic block 218 may be in the controller block 108 of FIG. 1. In general, one or more of these blocks may be implemented in hardware (e.g., microcontroller, an FPGA, ASIC, etc.), software, or a combination thereof. The memory device 216 may be an SRAM or another type of memory device. In some example embodiments, the power processing block 110 of FIG. 1 may include the power processor 208.

In some example embodiments, the memory device 216 may be used to store values (e.g., PWM values), as described above, in association with conduction duration values. For example, the first column of the memory device 216 may include memory locations that store conduction duration values, and the second column of the memory device 216 may include memory locations that store power generation parameter values, such as PWM values, that are default values or generated by the logic block 218 and stored in association with the conduction duration values. Alternatively, the first column may represent addresses corresponding to the conduction durations, and the second column may include memory locations containing power generation parameter values.

Figure 3:
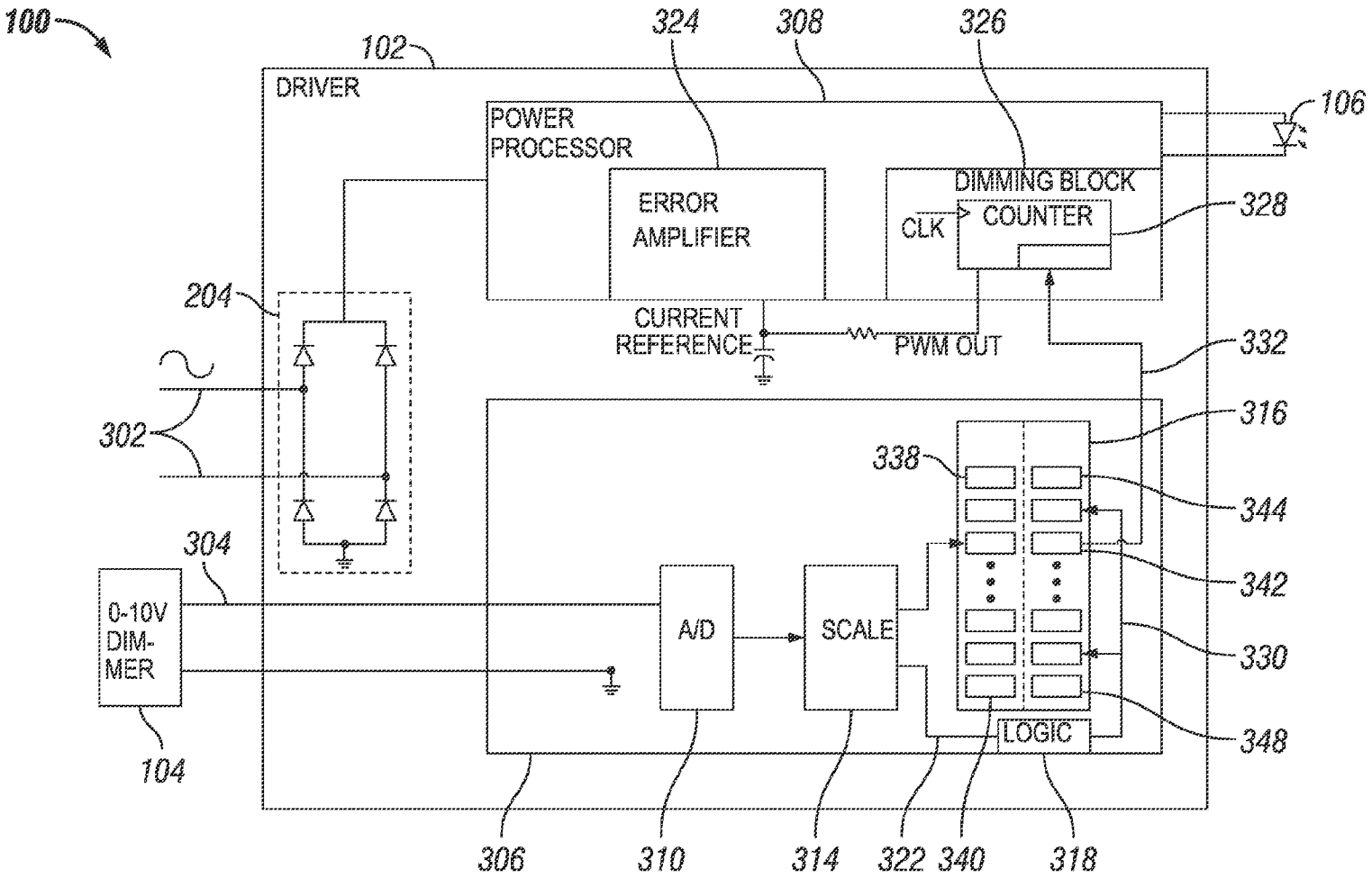
FIG. 3 illustrates details of the system of FIG. 1 according to another example embodiment.

FIG. 3 illustrates details of the system of FIG. 1 according to another example embodiment;

Referring to FIG. 3, the system 100 includes the adjustable lighting driver 102, the dimmer 104, and the LED light source 106. Power from a power source may be provided to the driver 102 via connections 302. The power provided to the driver 102 may be a switched power from the dimmer 104 or another source. The dimmer 104 may be a 0-10 volt dimmer that provides a dim control electrical signal to the driver 102 based on the dim level setting of the dimmer 104.

In general, the voltage level of the dim control electrical signal provided to the driver 102 by the dimmer 104 via a connection 312 corresponds to the dim level setting of the dimmer 104. For example, the brightest setting of the dimmer 104 may result in the highest voltage of the electrical signal, and the dimmest setting of the dimmer 104 may result in the lowest voltage of the electrical signal.

In some example embodiments, the driver 102 includes the rectifier 304, a controller 306, and a power processor 308. The rectifier 304 may receive and rectify the electrical signal that provides power to the driver 102. Although a particular rectifier is shown in FIG. 3, in alternative embodiments, a different rectifier may be used. As shown in FIG. 3, the rectified signal is provided to the power processor 308. The dim control electrical signal may be provided to the controller 306. For example, the controller 306 may include an analog-to-digital converter (A/D) 310, scaling block 314, a memory device 316, and a logic block 318. In some example embodiments, the scaling block and/or the logic block 218 may be implemented in hardware, software, or a combination thereof.

The A/D converter 206 may convert the dim control electrical signal into a digital signal and provide the digital signal to the scaling block 314. The scaling block 314 may scale the digital signal as necessary to use the scaled output signal of the scaling block 314 in operating of the driver 102. For example, the output of the scaling block may be used as an address to read and write values (e.g., PWM values) from/to the memory device 316.

During normal operations of the system 100, where a user uses the dimmer 104 to change the brightness level of light emitted by the LEDs 106, the output of the scaling block 314 is used by the driver 102 in the reading/outputting values from the memory device 316 that correspond to the voltage levels of the dim control electrical signal generated by the dimmer 104. The values read/output from the memory device 316 are be provided to the power processor 308 via a connection 332 (e.g., one or more electrical wires) and are be used by the power processor 308 in generating the output power that is provided to the LED light source 106. For example, the values stored in the memory device 316 may be duty cycle values, pulse-width, etc. that are used to control the amount of power provided to the LED light source 106. When the dim level setting of the dimmer 104 changes (which results in a change of the voltage level of the dim control electrical signal), a value corresponding to the changed voltage level may be read from the memory device 316, resulting in a different amount of power being provided by the power processor 308 to the LED light source 106.

In some example embodiments, the power processor 308 may include an error amplifier 324 and a dimming block 226 that includes a pulse-width-modulation (PWM) generator 328. For example, the PWM generator 328 may receive a value (e.g., a pulse-width value) stored in the memory device 316, and the dimming block 326 in conjunction with the error amplifier 324 may operate to control the amount of output power provided to the LED light source 106.

In some example embodiments, the values stored in the memory device 316 may be default (e.g., set by manufacturer of the driver 102) or previously user programmed values that are stored in association with respective conduction durations of the electrical signal from the dimmer 104. For example, the default or user programmed values may be pulse-width-modulation values. To illustrate, based on a default value stored in the memory device 316, the driver 102 may provide a maximum amount of output power to the LED light source 106 when the electrical signal from the dimmer 104 has the maximum conduction duration. As explained above, the electrical signal generated by the dimmer 104 may have the maximum conduction duration when the dimmer 104 is set to the brightest setting.

In some example embodiments, the driver 102 may be programmed to change the brightness level of the light emitted by the LED light source 106 for a particular dim level setting of the dimmer 104. In particular, the driver 102 may be programmed to change the amount of power that the driver 102 provides to the LED light source 106 for a particular voltage level of the dim control electrical signal provided by the dimmer 104 via the connection 312. To illustrate, the driver 102 may be programmed such that, when the dimmer 104 is set to the brightest setting of the dimmer 104, the driver 102 provides to the LED light source 106 output power that is less than the maximum output power, which may be the default output power that corresponds to the brightest setting of the dimmer 104.

In some example embodiments, after the driver 102 enters a programming mode, the driver 102 may be programmed/reset to provide the maximum output power to the LED light source 106 when the dimmer 104 is set to the brightest setting. For example, the memory device 316 may be loaded with default values (e.g., PWM values based on manufacturer's configuration) that correspond to different dim level settings of the dimmer 104. In some example embodiments, the default values may be stored in another memory device.

After the driver 102 is programmed/reset to provide the maximum output power to the LED light source 106, the dimmer 104 may be set to a dim level setting that results in the LED light source 106 emitting a light having a desired brightness level. The logic block 318 may then determine the value (e.g., PWM value) read from the memory device 316 and that resulted in the desired brightness level. The logic block 318 may then store the value in the memory device 316 in association with the maximum voltage level of the dim control electrical signal, which is reflective of the brightest setting of the dimmer 104. For example, the logic block 318 may store the value in the memory location 344 in association with the location/address/index 338, which corresponds to the maximum voltage level of the dim control electrical signal provided to the driver 102 when the dimmer 104 is set to the brightest setting. The logic block 318 may store the value in the memory device 316 via a connection 330, which may include one or more electrical connections.

The logic block 218 may also store, in the memory device 216, other values in association with other voltage levels of the dim control electrical signal generated by the dimmer 104. For example, the location/address/index 340 may correspond to the minimum voltage level of the dim control electrical signal, and a value corresponding to a minimum output power provided to the LED light source 106 may be stored in memory location 348. The logic block 318 may determine (e.g., calculate, retrieve, etc.) values that correspond to other amounts of the output power of the driver 102 based on the value stored in the memory location 344 and the value stored in the memory location 248. For example, the logic block 318 may generate the values based on a desired dimming curve, such as a linear curve, a square law curve, an S curve, etc. The values may be stored in memory locations such as memory location 342 in association with respective voltage levels of the dim control electrical signal provided to the driver 102 by the dimmer 104.

After the programming of the driver 102 is completed as described above, the driver 102 may be operated in a normal mode to provide power to the LED light source 106 based on the dim level setting of the dimmer 104. Because the driver 102 has been programmed to provide to the LED light source 106 less power than the maximum (e.g., default) output power when the dimmer 104 is set to the brightest setting, the light emitted by the LED light source 106 is dimmer as compared to the brightness level prior to the programming of the driver 102.

In some example embodiments, the rectifier 304, the controller 306, the A/D 310, the scaling block 314, the memory device 316, and the logic block 318 may be in the controller block 108 of FIG. 1. In general, one or more of these blocks may be implemented in hardware (e.g., microcontroller, an FPGA, ASIC, etc.), software, or a combination thereof. The memory device 316 may be an SRAM or another type of memory device. In some example embodiments, the power processing block 110 of FIG. 1 may include the power processor 308.

Figure 4:
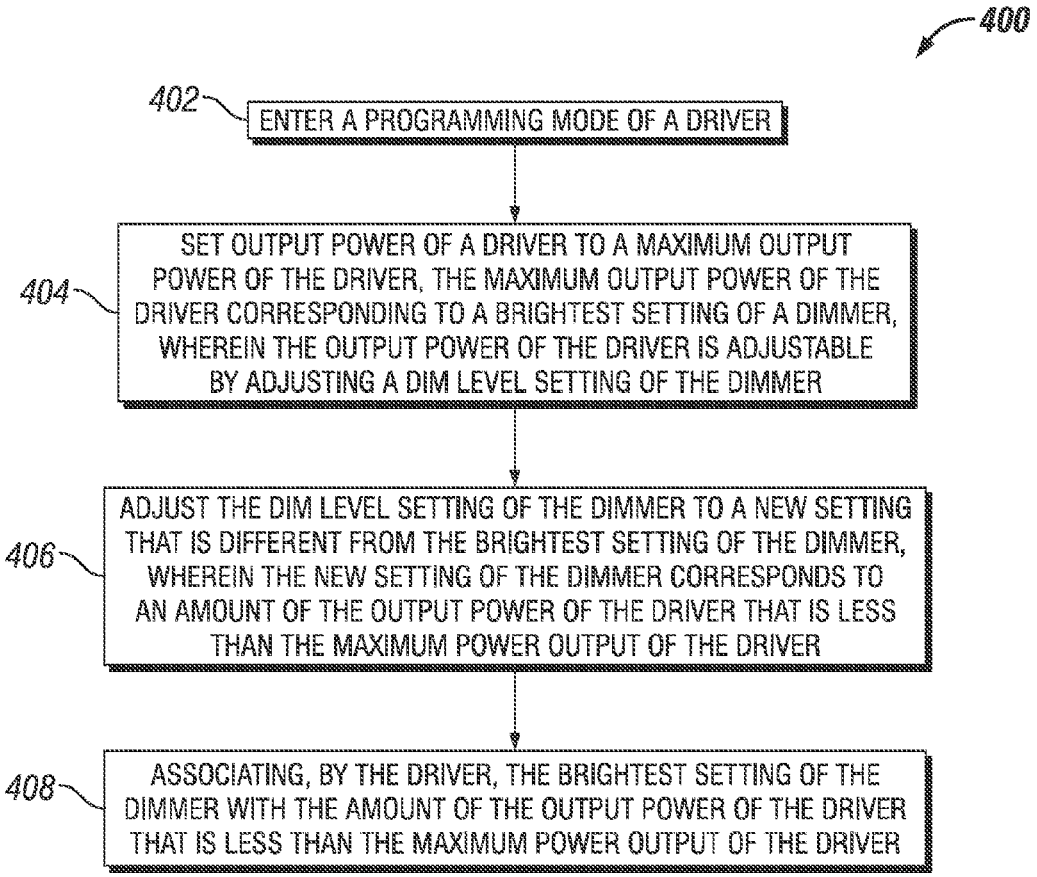
FIG. 4 is a flowchart illustrating a method of operating the lighting system of FIG. 1 according to an example embodiment.

FIG. 4 is a flowchart illustrating a method 400 of operating the lighting system 100 of FIG. 1 according to an example embodiment. Referring to FIGS. 1-4, at step 402, the method 400 includes entering a programming mode of the driver 102. For example, the programming mode selection input (e.g., a push-button, a keyboard input, a signal from another device, etc.) shown in FIG. 1 may be used to enter the programming mode of the driver 102. Alternatively, other means as may be contemplated by those of ordinary skill in the art with the benefit of this disclosure may be used to enter the programming mode.

At step 404, the method 400 includes setting output power of the driver 102 to a maximum output power of the driver 102. The maximum output power of the driver 102 corresponds to a brightest setting of a dimmer 104. For example, the maximum output power of the driver 102 may be the amount of power the driver 102 provides to the LED light source 106, based on the default (e.g., manufacturer setting) values (e.g., duty cycle, pulse width, etc.) stored in the memory device 216, 316, when the dimmer 104 is set to the brightest setting. Along with setting the output power of the driver 102 to a maximum output power of the driver 102, the driver 102 may be set to provide other default amounts of the output power of the driver 102 to the LED light source 106 based on other dim level settings of the dimmer 104. The output power of the driver 102 is adjustable by adjusting a dim level setting of the dimmer 104.

At step 406, the method 400 includes adjusting the dim level setting of the dimmer 102 to a new setting that is different from the brightest setting of the dimmer 104, where the new setting of the dimmer 104 corresponds to an amount of the output power of the driver 102 that is less than the maximum output power of the driver 102. To illustrate, the new setting of the dimmer 104 may result in a desired brightness level of the light emitted by the LED light source 106 that is dimmer than the brightness level of the light resulting from the maximum amount of power being provided to the LED light source 106.

A value corresponding to the new setting of the dimmer 104 is stored in the memory device 16, 316 in association within the brightest dimmer setting of the dimmer 104, which may be represented by the conduction duration of the electrical signal provided by the dimmer 104 or by a scaled voltage level of the dim control electrical signal.

In some example embodiments, the method 400 may include exiting the programming mode, where the light emitted by the LED light source 106 is dimmer as compared to the brightness level of the light prior to the programming of the driver 102.

In some example embodiments, step 402 may be performed after setting output power of the driver 102 to a maximum output power of the driver 102 at step 404. In some alternative embodiments, the method 400 may include other steps without departing from the scope of this disclosure.

Figure 5:
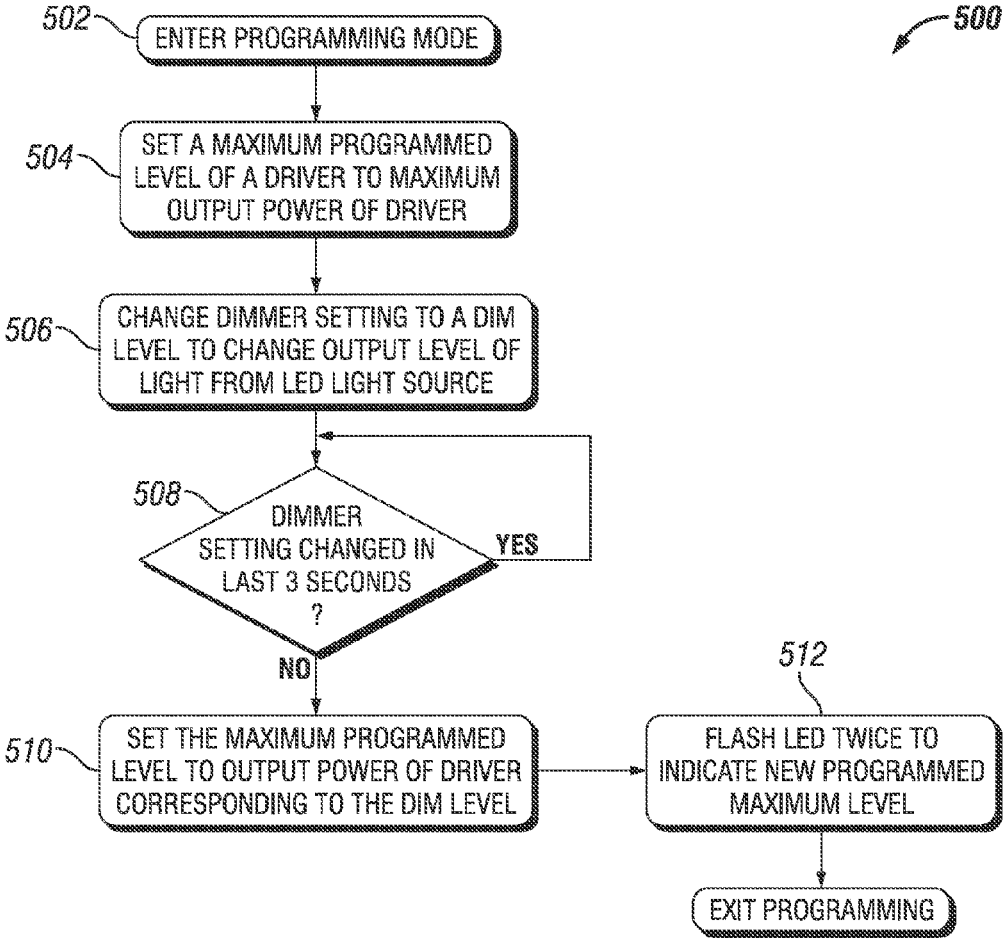
FIG. 5 is a flowchart illustrating a method of operating the lighting system of FIG. 1 according to another example embodiment.

FIG. 5 is a flowchart illustrating a method 500 of operating the lighting system 100 of FIG. 1 according to another example embodiment. Referring to FIGS. 1-3 and 5, at step 502, the method 500 includes entering a programming mode of the driver 102. For example, the programming mode selection input (e.g., a push-button, a keyboard input, a signal from another device, etc.) shown in FIG. 1 may be used to enter the programming mode of the driver 102. Alternatively, other means as may be contemplated by those of ordinary skill in the art with the benefit of this disclosure may be used to enter the programming mode. At step 504, the method 500 includes setting a maximum program level of the driver 102 to maximum output power of the driver 102. The memory locations 244, 344 may be programmed to have values that result in a maximum output power being provided to the LED light source when the dimmer 104 is set to the brightest setting of a dimmer 104.

At step 506, the method 500 includes changing the dimmer setting to a dim level to change output level (i.e., brightness level) of the light emitted by the LED light source 106. For example, the dim level may be changed by a user until the light has a desired brightness level. At step 508, the method 500 includes determining whether the dim level setting of the dimmer 104 has changed in the last three seconds. Alternatively, other time durations may be used. If the dim level setting has changed, the method 500 keeps performing step 508 until no change in the dim level setting is detected in prior 3 seconds or other suitable time period. When no change is detected in the dim level setting, the method continues to step 510 to set the maximum programmed level to output power of the driver 102 corresponding to the dim level the was held unchanged in step 508.

At step 512, the method 500 includes flashing the LED light source 106 or another indicator LED twice (or few or more than twice) to indicate a new maximum level has been programmed. After the exiting the programming mode, the light emitted by the LED light source 106 is dimmer as compared to the brightness level of the light prior to the programming of the driver 102.

Although particular embodiments have been described herein in detail, the descriptions are by way of example. The features of the example embodiments described herein are representative and, in alternative embodiments, certain features, elements, and/or steps may be added or omitted. Additionally, modifications to aspects of the example embodiments described herein may be made by those skilled in the art without departing from the spirit and scope of the following claims, the scope of which are to be accorded the broadest interpretation so as to encompass modifications and equivalent structures.

What is claimed is:

1. A method of adjusting output power of a lighting driver that corresponds to a brightest setting of a dimmer, the method comprising:

setting output power of a driver to a maximum output power of the driver, the maximum output power of the driver corresponding to a brightest setting of a dimmer, wherein the output power of the driver is adjustable by adjusting a dim level setting of the dimmer;

adjusting the dim level setting of the dimmer from the brightest setting of a dimmer to a new setting of the dimmer during a programming mode of the dimmer, wherein the brightest setting of the dimmer results in a maximum brightness level of a light emitted by a light source powered by the driver, wherein the new setting of the dimmer is selected to produce a new brightness level of the light that is dimmer than the maximum brightness level of the light, and wherein the new setting of the dimmer results in an amount of the output power of the driver that is less than the maximum output power of the driver; and associating, by the driver, the brightest setting of the dimmer with the amount of the output power of the driver that is less than the maximum output power of the driver such that subsequent adjustment of the dim level setting of the dimmer to the brightest setting of the dimmer results in the new brightness level of the light instead of the maximum brightness level of the light.

2. The method of claim 1, further comprising entering a programming mode of the driver, wherein the steps of setting the output power of the driver and associating the brightest setting of the dimmer with the amount of the output power of the driver are performed in the programming mode of the driver.

3. The method of claim 1, wherein the dimmer is a phase-cut dimmer and wherein the brightest setting of the dimmer corresponds to a maximum conduction duration of an electrical signal generated by the dimmer before and after the brightest setting of the dimmer is associated by the driver with the amount of the output power of the driver that is less than the maximum output power of the driver.

4. The method of claim 1, wherein associating the brightest setting of the dimmer with the amount of the output power of the driver that is less than the maximum output power of the driver comprises storing a value corresponding to the amount of the output power of the driver in association with a value corresponding to the brightest setting of the dimmer.

5. The method of claim 4, further comprising generating and storing values corresponding to different amounts of the output power of the driver that are less than the amount of the output power of the driver that is less than the maximum output power of the driver, wherein the values are stored in association with values corresponding to different settings of the dim level setting of the dimmer.

6. The method of claim 5, wherein the values corresponding to different amounts of the output power of the driver are generated based on the value corresponding to the amount of the output power of the driver that is less than the maximum output power of the driver and a desired dimming curve.

7. The method of claim 6, wherein the desired dimming curve is a linear curve, an S curve or a square law curve.

8. The method of claim 1, wherein the dimmer is a 0-10 volt dimmer.

9. The method of claim 1, wherein the step of adjusting the dim level setting of the dimmer from the brightest setting of a dimmer to the new setting of the dimmer during the programming mode of the dimmer is performed by adjusting the dim level setting of the dimmer while visually checking the light emitted by the light source until the new brightness level of the light emitted by the light source has the new brightness level.

10. A lighting system, comprising:

a dimmer;

a light source; and an adjustable lighting driver coupled to the dimmer and to the light source, the adjustable lighting driver comprising:

a memory device to store power level values corresponding to different amounts of output power of the driver, wherein the power level values are stored in the memory device in association with dim values corresponding to different dim level settings of the dimmer, and wherein the adjustable lighting driver provides the output power to the light source based on the power level values and the different dim level settings;

a logic module to generate a first power level value that corresponds to a new dim level setting of the dimmer based on an adjustment of the dimmer from a brightest setting of the dimmer to the new dim level setting of the dimmer during a programming mode of the dimmer, wherein the first power level value is stored in the memory device in association with the brightest setting of the dimmer, and wherein the new dim level setting of the dimmer corresponds to an amount of the output power of the driver that is less than a maximum output power of the driver associated with the brightest setting of the dimmer prior to the first power level value being stored; and a power processor to provide the output power to the light source based on the power level values stored in the memory device, wherein the power processor provides to the light source the amount of the output power of the driver that is less than the maximum output power of the driver based on the first power level value when the dimmer is set to the brightest setting of the dimmer.

11. The system of claim 10, wherein the dimmer is a phase-cut dimmer and wherein the brightest setting of the dimmer corresponds to a maximum conduction duration of an electrical signal generated by the dimmer.

12. The system of claim 11, wherein the dim values corresponding to different dim level settings of the dimmer are conduction duration values of the electrical signal.

13. The system of claim 10, wherein the dimmer is a 0-10 volt dimmer.

14. The system of claim 10, wherein the driver provides the output power to the light source by providing an electrical signal to the light source and wherein a pulse width of the electrical signal corresponds to a power level value of the values stored in the memory device corresponding to a particular dim level setting of the dimmer.

15. The system of claim 10, wherein the power level values corresponding to the different amounts of the output power of the driver are generated based on the first power level value of the power level values stored in the memory device and a desired dimming curve.

16. The system of claim 10, wherein the logic module generates the values that are stored in the memory device during the programming mode of the adjustable lighting driver.

17. A lighting fixture, comprising:

a light emitting diode (LED) light source comprising one or more LEDs; and an adjustable lighting driver coupled to the light source, the adjustable lighting driver comprising:

a memory device to store power level values corresponding to different amounts of output power of the driver, wherein the power level values are stored in the memory device in association with dim values corresponding to different dim level settings of the dimmer, and wherein the adjustable lighting driver provides the output power to the light source based on the power level values and the different dim level settings;

a logic module to generate a first power level value that corresponds to a new dim level setting of the dimmer based on an adjustment of the dimmer from a brightest setting of the dimmer to the new dim level setting of the dimmer during a programming mode of the dimmer, wherein the first power level value is stored in the memory device in association with the brightest setting of the dimmer, and wherein the new dim level setting of the dimmer corresponds to an amount of the output power of the driver that is less than a maximum output power of the driver associated with the brightest setting of the dimmer prior to the first power level value being stored; and a power processor to provide the output power to the light source based on the power level values stored in the memory device, wherein the power processor provides to the light source the amount of the output power of the driver that is less than the maximum output power of the driver based on the first power level value when the dimmer is set to the brightest setting of the dimmer.

18. The lighting fixture of claim 17, wherein the adjustable lighting driver provides the output power to the LED light source by providing an electrical signal to the LED light source and wherein a pulse width of the electrical signal corresponds to a power level value of the power level values stored in the memory device.

19. The lighting fixture of claim 17, wherein the power level values corresponding to the different amounts of the output power of the driver are generated based on the first power level value of the power level values stored in the memory device and a desired dimming curve.

20. The lighting fixture of claim 17, wherein the values corresponding to the different dim level settings of the dimmer are conduction duration values of the electrical signal generated by a phase-cut dimmer.

* * * * *